US006971226B2

(12) United States Patent
Boehnke

(10) Patent No.: US 6,971,226 B2
(45) Date of Patent: Dec. 6, 2005

(54) PROCEDURE FOR PREPARING A PIECING PROCESS IN AN OPEN-END ROTOR SPINNING UNIT

(75) Inventor: Bernhard Boehnke, Uhingen (DE)

(73) Assignee: Spindelfabrik Suessen Schurr Stahlecker & Grill GmbH, Suessen (DE)

( * ) Notice: Subject to any disclaimer, the term of this patent is extended or adjusted under 35 U.S.C. 154(b) by 0 days.

(21) Appl. No.: 10/858,411

(22) Filed: Jun. 2, 2004

(65) Prior Publication Data

US 2005/0011176 A1 Jan. 20, 2005

Related U.S. Application Data

(63) Continuation of application No. PCT/EP02/10555, filed on Sep. 20, 2002.

(30) Foreign Application Priority Data

Dec. 4, 2001 (DE) ..... 101 60 455

(51) Int. Cl.[7] ..... D01H 15/00
(52) U.S. Cl. ..... 57/263
(58) Field of Search ..... 57/22, 261, 263, 57/308; 242/475.1–475.6

(56) References Cited

U.S. PATENT DOCUMENTS

| | | | | |
|---|---|---|---|---|
| 4,653,258 | A * | 3/1987 | Rohner | 57/22 |
| 5,163,279 | A * | 11/1992 | Stahlecker | 57/86 |
| 6,402,079 | B1 * | 6/2002 | Hermanns et al. | 242/475.5 |

FOREIGN PATENT DOCUMENTS

| | | | | |
|---|---|---|---|---|
| DE | 23 42 545 | | 3/1975 | |
| DE | 26 20 811 | | 12/1977 | |
| DE | 4224633 | A1 * | 1/1994 | B65H 69/06 |
| DE | 199 54 674 | | 5/2001 | |
| JP | 61063731 | A * | 4/1986 | D01H 13/30 |

* cited by examiner

*Primary Examiner*—John J. Calvert
*Assistant Examiner*—Shaun R Hurley
(74) *Attorney, Agent, or Firm*—Crpwell & Moring LLP

(57) ABSTRACT

In the case of a procedure for preparing a piecing process in an open-end rotor spinning aggregate it is provided that a thread end, which is to be pieced in a fiber ring located in a spinning rotor, is first cross-cut, thinned-out and moistened. The dampening takes place subsequent to the thread being thinned-out, in that the thread end slides over a wetting surface.

23 Claims, 3 Drawing Sheets

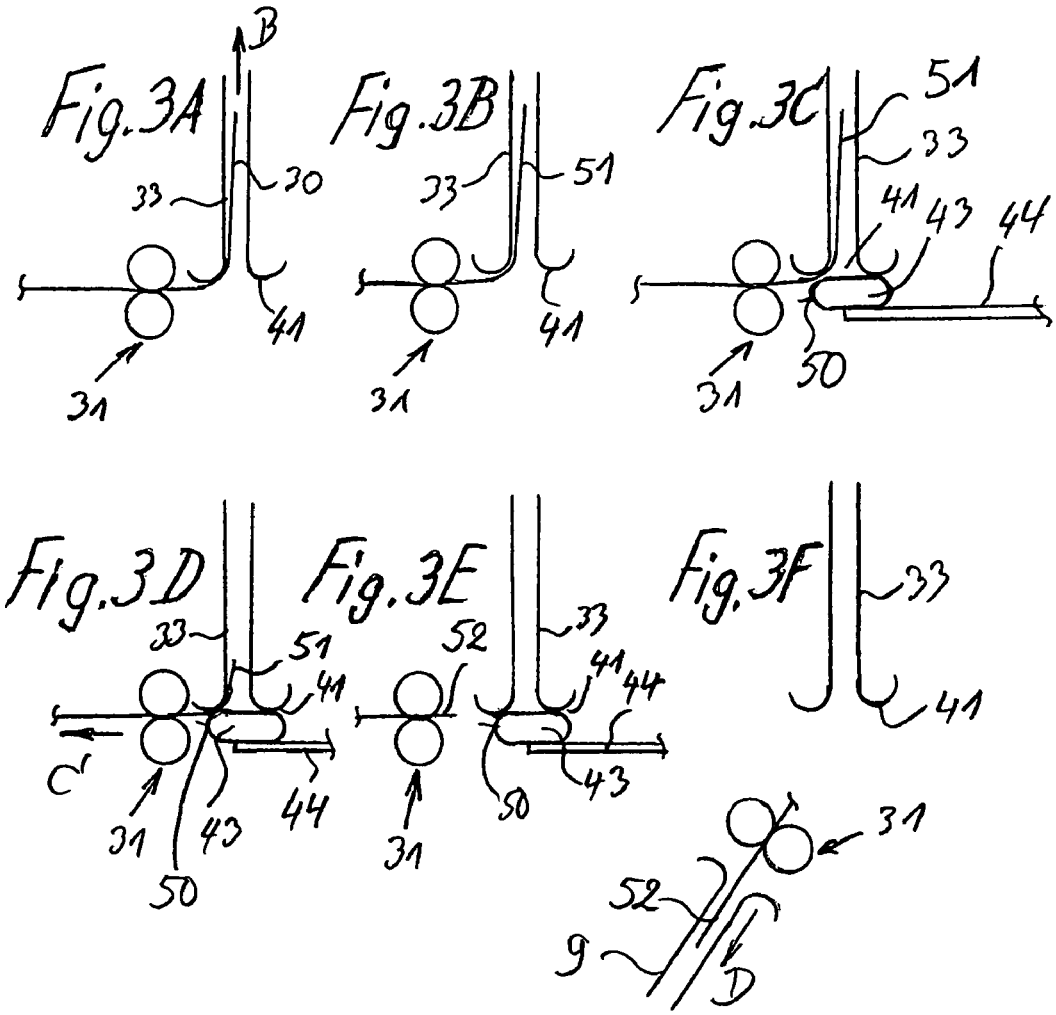
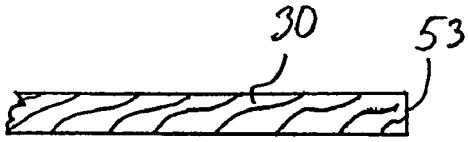
Fig. 4A
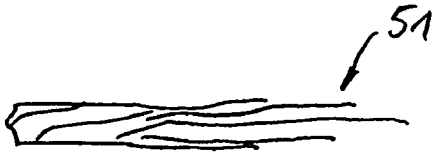
Fig. 4B
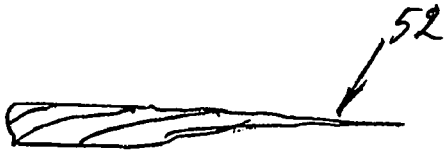
Fig. 4C

PROCEDURE FOR PREPARING A PIECING PROCESS IN AN OPEN-END ROTOR SPINNING UNIT

BACKGROUND AND SUMMARY OF THE INVENTION

This application is a continuation of International Patent Application No. PCT/EP02/10555 filed on Sep. 20, 2002, designating the United States of America, the entire disclosure of which is incorporated herein by reference. Priority is claimed based on Federal Republic of Germany Patent Application No. 101 60 455.6 filed Dec. 4, 2001.

The present invention relates to a procedure for preparing a piecing process in an open-end rotor spinning aggregate, whereby a cross-cut fiber thread to be pieced to a fiber ring located in a spinning rotor is thinned out and dampened.

A process of this kind is prior art in German published patent application 199 54 674. In this known procedure, a bonding means, in this case the simplest, that is, water, is applied before piecing to the already cross-cut thread end during a pneumatic thinning-out process. Thinning out occurs in a suction tube, whereby the suction air stream is generated by means of injection via compressed air nozzles. The bonding means is added to the compressed air, while the thinned-out thread end, temporarily remains in a stationary state, and is thereby suctioned. Because of the pneumatic thinning out in the suction tube, the previously present yarn twist is removed from the thread end to be pieced, so that a thread brush which is to be fed to the fiber ring in the spinning rotor arises. The bonding means serves to consolidate the piecing point in the spinning rotor to a certain degree when the thread end, which is guided back into the spinning rotor, is suddenly reversed in its direction of motion for removing the pieced thread.

Because in the known process, the bonding means is added to the compressed air to be blown into the suction tube, the inside of the suction tube is also dampened. The suction tube can then, in particular when honey dew or such similar substances adhere to the fiber material, become sticky. By blowing in the bonding means, these reach other functional elements and in time, the effectiveness of the piecing device becomes impaired. In addition, the thread end becomes too moist, so that as a rule, a drying process is necessary after the piecing process. The bonding means, even if only water, sprayed into the suction tube makes the thinning out of the thread end difficult.

It is an object of the present invention to eliminate the disadvantages of the above mentioned process while maintaining its advantages, in particular to avoid an undesirable dampening of any functional elements, to also avoid a too high a moisture content of the thread end and not to hinder the thinning out of the thread end.

This object has been achieved in accordance with the present invention in that the dampening takes place subsequent to the thinning out in that the thread end slides along a moistening surface.

Because the moistening of the thread end takes place subsequent to the thinning out process, and not, as in prior art, during the thinning out process, the thinning out is not hindered in any way. Thinning out serves to present a thread end to the fiber ring located in the spinning rotor, which thread end prevents to a large extent thick spots occurring during piecing. Because the thread end is subsequently moistened, the thinning out device does not become covered with moisture. The moistening surface, along which the thread end to be pieced and moistened slides, serves also as a wiping surface and ensures that not too much moisture is applied to the thread end. The thread end, which previously has been reduced to a thinned-out fiber brush, is now formed to a thread tip, whose fibers can be guided exactly back through a tiny guiding tube to the spinning rotor. The moistening, even though it is only slight, also results in an increase in the reliability of the piecing process due to a temporary bonding. In the case of the moistening surface, a sponge or a piece of felt can be involved. The thinning out of the thread end is advantageously carried out with the effect of an air current, whereby the subsequent moistening takes place without the air current. The dampness which moistens the thread end is thus not blown onto any other functional elements, and, because the thread end is only moistened after being thinned-out, the tendency does not arise for the thinning out of the thread end to a thread brush to be hindered during the thinning out process. The functions of the thinning out and the moistening are separated from one another in a practical way.

In a further embodiment of the present invention, the degree of dampness on the moistening surfaces is dependent on the number of piecing processes. This reliably ensures that the thread end is not too damp and in no way becomes wet. The dampness in the moistening surfaces, for example, a sponge, must be regulated by the control system of the piecing device, as the number of end breaks to be repaired is registered within a certain time lapse. The present invention relates also to a device for preparing a piecing process in an open-end rotor spinning aggregate, comprising a suction tube for thinning out the thread end, said tube having an entry opening for a cross-cut thread end to be pieced, also comprising a device arranged at the suction tube for moistening the thread end, as is known in principle from the above mentioned German published patent application 199 54 674. In accordance with the present invention, it is provided for the known arrangement that the device for dampening comprises a moistening surface which can be arranged at the entry opening of the suction tube after the thinning out process, and along which surface the thinned-out thread end slides when being removed from the suction tube. In this way, other functional elements, and above all the inside of the suction tube, are not moistened with dampness in an undesired way, while the thinning out process is also not impaired. Dampening takes place only subsequent to the thinning process and only after the suction air or the pressurized air fed into the suction tube have been switched off.

The moistening surface of the device can comprise a sponge or the like which can be dampened. It should only be removable from the suction tube when the thread end has been completely removed from the suction tube. A container, preferably controlled by a magnetic valve and containing water, can be arranged at the moistening surface. A control system is then most practically arranged at the magnetic valve which is connected to a counting device for piecing processes.

BRIEF DESCRIPTION OF THE DRAWINGS

These and further objects, features and advantages of the present invention will become more readily apparent from the following detailed description thereof when taken in conjunction with the accompanying drawings wherein:

FIGS. 3A to 3F schematically depict individual procedural steps of the thinning out process and the dampening process of a thread end to be spun; and FIGS. 4A to 4C show the thread end to be spun during the individual procedural steps.

DETAILED DESCRIPTION OF THE DRAWINGS

Figure 1:
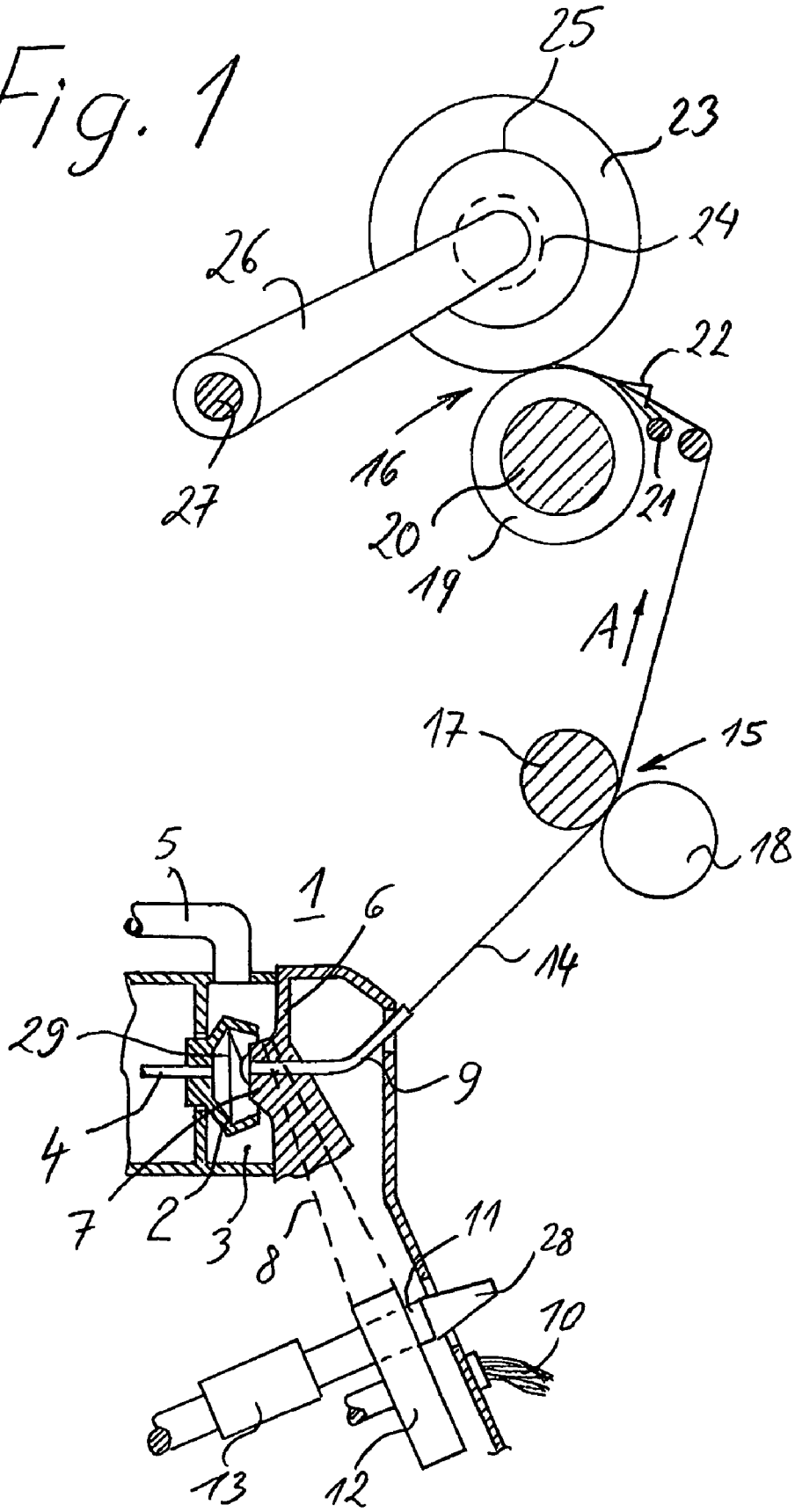
FIG. 1 is a partly sectional side view of an open-end rotor spinning aggregate.

The in FIG. 1 only partly shown open-end rotor spinning aggregate 1 comprises a spinning rotor 2, which rotates in the known way in a vacuum chamber 3. The shaft 4 of the spinning rotor 2 is supported and driven outside of the vacuum chamber 3 in a way not shown. The vacuum chamber 3 is connected via a vacuum conduit 5 to a vacuum source (not shown).

During operation, the open front side of the vacuum chamber 3 is closed by means of a cover 6, which projects into the inside of the spinning rotor 2 by means of an extension 7. The extension 7 comprises the mouth of a fiber feed channel 8 as well as the initial part of a fiber withdrawal channel 9.

In the spinning aggregate 1, fiber material in the form of a sliver 10 is fed in the known way by means of a feed roller 11 and is opened to single fibers by means of an opening roller 12, which single fibers are fed to the spinning rotor 2 via the fiber feed channel 8. In the case of an end break, the feed roller 11, controlled by a yarn detector (not shown), is brought to a standstill via a coupling 13, so that although the opening roller 12 continues to rotate, no more fibers reach the inside of the spinning rotor 2. In the case of an end break, a piecing process must be carried out, which is described below.

During normal spinning operation, a spun thread 14 is withdrawn in delivery direction A by means of a delivery roller pair 15 and fed to a winding device 16. The delivery roller pair 15 comprises a driven delivery cylinder 17 which extends along all the spinning stations, as well as one pressure roller 18 arranged at each spinning aggregate 1. The winding device 16 comprises one winding roller 19 per spinning aggregate 1, whereby all the winding rollers 19 of the spinning aggregate 1 of one machine side are driven by a drive shaft 20 extending in machine longitudinal direction. Furthermore, in the known way, a fiber guiding rod 21 as well as a traversing yarn guide 22 are also components of the winding device 16.

The winding roller 19 drives a cross package 23 during operation, onto which the withdrawn thread 14, with the aid of the traversing yarn guide 22, is wound. The cross package 23 is supported in the known way in a package holder 26 by means of a winder tube 24 between two lateral tube discs 25. The package holder 26 can be swivelled around a swivel axle 27, so that, in spite of the pressure of the cross package 23 on its winding roller 19, the package holder 26 can be moved upwards.

The feed roller 11 is provided with a driving pinion 28, which projects through the cover 6 towards the operator's side, so that when the feed roller 11 is at a standstill, it can still be temporarily driven by an external drive despite the coupling 13 being out-of-gear.

If, for whatever reason, a spun thread 14 breaks, the spinning process must be subsequently re-started by means of a piecing process. A piecing device which travels up and down the spinning machine in longitudinal direction serves this purpose in the known way. A length of the thread 14, which has already been wound onto the cross package 23, is unwound and a thread end to be pieced is prepared in a way described below, which thread end can be guided back, in the opposite direction to the operation delivery direction, through the yarn withdrawal channel 9 into the spinning rotor 2, where it can pieced to a fiber ring 29 located there. This piecing process is critical, as the pieced thread should not deviate too much from the quality of a normally spun thread 14, while a certain degree of reliability is also essential for the piecing process, which means that the process should function without an immediate subsequent recurrence of an end break.

Figure 2:
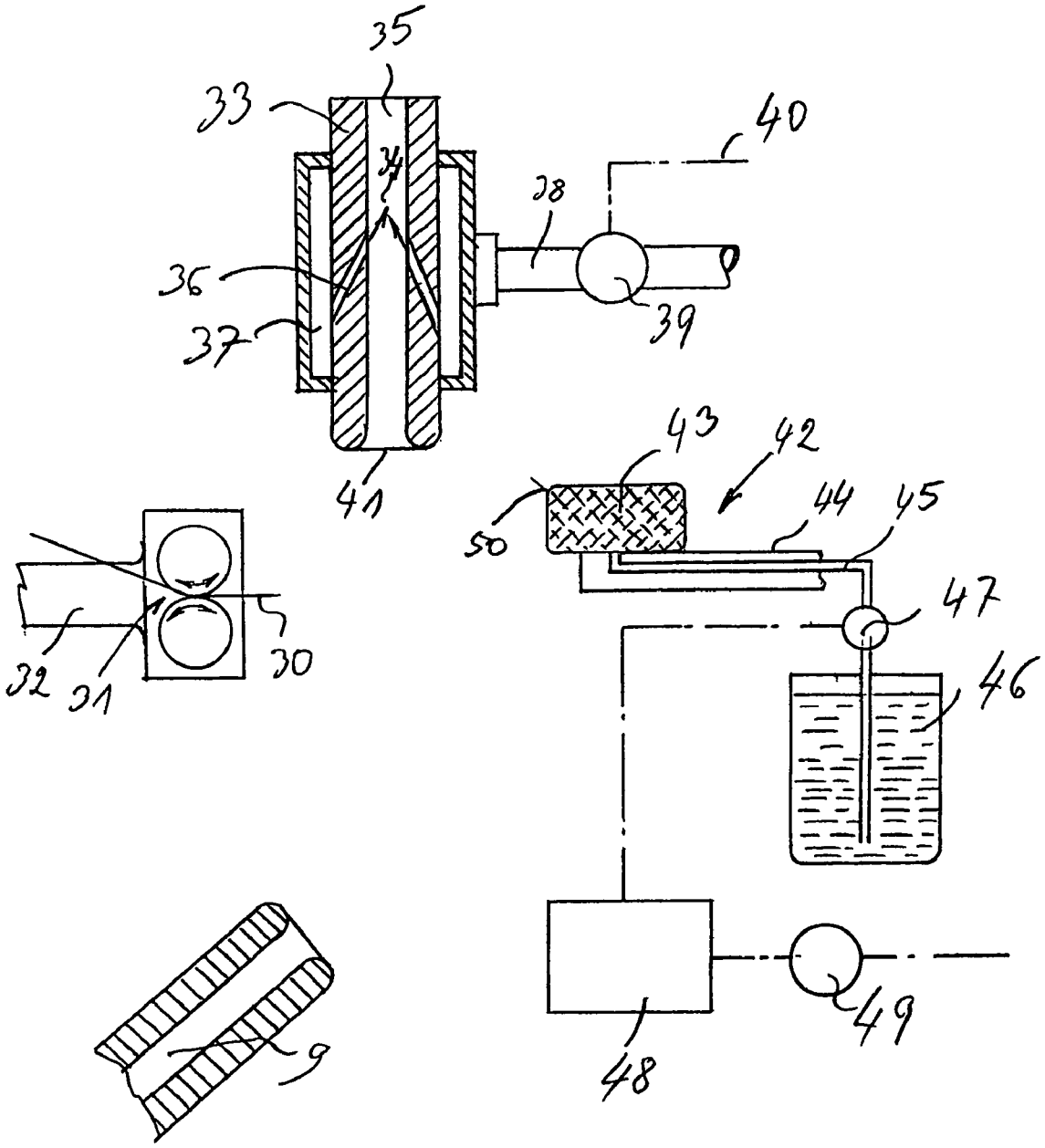
FIG. 2 is a schematic view of individual functional elements, which are required for the thinning out and dampening of a thread end to be spun.

In the schematic depiction in FIG. 2, the end area of the above mentioned yarn withdrawal channel 9, which is part of the spinning aggregate 1, can be seen, while the remaining functional elements in FIG. 2 are part of the piecing device which is not drawn in any further detail.

The piecing device comprises a nipping roller pair 31, which can be driven in both rotational directions, and which can also be opened and closed. This nipping roller pair 31 is located on a placing device 32, in the form of, for example, a lever, and can feed the thread end 30 to be spun to various functional elements, among them the yarn withdrawal channel 9. It is to be presumed that the thread end 30 has been cut in a cutting process to the desired length. Furthermore, a suction tube 33 is part of the piecing device, which is essentially cylindrical in design and which comprises an air channel 35, into which injected pressurized air is blown through pressurized air nozzles 36, see air arrows 34. For this purpose, the suction tube 33 can be surrounded by a ring channel 37, into which a pressurized air conduit 38 runs via a valve 39. The latter can be connected via an electric cable 40 to a system control unit (not shown). The suction tube 33 comprises a well rounded entry opening 41, in which a previously cross-cut and yet to be further thinned-out fiber end 30 can be inserted by means of the placing device 32.

A further device 42 for moistening the cross-cut and subsequently thinned-out thread end 30 is part of the piecing device. This device 42 can comprise a sponge 43 or the like, while also comprising a placing device 44 which can be connected via a conduit 45, a wick or another element to a container 46 which holds water. The container 46 can be connected via a magnetic valve 47 to the placing device 44, which valve 47 in turn is connected to a control system 48 and to a counting device 49 for piecing processes.

The sponge 43 of the device 42 has a moistening surface 50, which can be placed at the entry opening 41 in a way described below.

As already mentioned, the cross-cut thread end 30 to be pieced is to be thinned-out in the inside of the suction tube 33 and subsequently moistened. This moistening takes place in that the already thinned-out thread end 30 slides along the moistening surface 50, which is arranged at the entry opening 41, after the pressurized air current has been switched off. Thus the thinning out of the thread end 30, which is carried out with the aid of an air current, is not impaired by the subsequent moistening process. Furthermore, the degree of dampness of the moistening surface 50 is dependent on the number of piecing processes. With the aid of the schematic and greatly scaled down FIGS. 3A to 3F, the thinning out and subsequent moistening processes of the thread end 30 are described below.

According to FIG. 3A, the nipping roller pair 31 has just fed the cross-cut thread end 30 through the entry opening 41, where the thread end 30 remains for a short while. The air current which is effective during the thinning out process is denoted by the arrow B. A thinned-out thread end 51 arises, from which the spinning twist of the original thread 14 still present is removed and which is prepared to the shape of a thread brush. This state is shown in FIG. 3B. The suction air can thereafter be switched off, which is denoted in FIG. 3B in that the arrow B is no longer present.

While the thinned-out thread end 51 is waiting in the suction tube 33, a sponge 43 comprising a moistening surface 50 is positioned at the entry opening 41 of the suction tube 33, as shown in FIG. 3C. In FIG. 3D, when the thinned-out thread end 51 is removed from the suction tube 33 by means of the nipping roller pair 31 in arrow direction C, the thread end 51 slides along the moistening surface 50, is very slightly moistened and formed to a thread tip, as is known in the case of a moistened water-color brush.

In the procedural step according to FIG. 3E, a thinned-out and moistened thread end 52 is present, which has been withdrawn completely from the suction tube 33. The sponge 43 can only now be removed again from the suction tube 33, as shown in FIG. 3F. It can be further seen in the lower area of FIG. 3F that the nipping roller pair 31 is guiding the moistened thread end 52 into the thread withdrawal channel 9 according to the arrow direction D. This process is facilitated in that the cross-cut, thinned-out and now also moistened thread end 52 projects out of the nipping roller pair 31 like the tip of a spear, so that accuracy for entry into the thread withdrawal channel 9 is ensured. The moistening fluid, however small the amount, results in a temporary bonding when the thread end 52 reaches the fiber ring 29, so that, in addition, an increased piecing reliability is provided.

The respective state of the thread end is described with the aid of FIGS. 4A to 4C in greatly enlarged dimensions.

In FIG. 4A, the cross-cut thread end 30 and its smooth area 53 which has been cut off in a cutting device can be seen. This is the state that exists before the thread end 30 is guided into the suction tube 33 as shown in FIG. 3A.

According to FIG. 4B, the originally cross-cut thread end 30 is now thinned-out to a thread brush 51, as shown above in FIG. 3B.

After the thinned-out thread end 51 has been withdrawn and slid along the moistening surface 50, a moistened thread end 52 in the form of tapering tip is present, which is guided back to the fiber ring 29.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for preparing a piecing process in an open-end rotor spinning aggregate, whereby a cross-cut fiber thread to be pieced in a fiber ring located in a spinning rotor is thinned-out and moistened, wherein the moistening takes place after the thinning-out process by means of sliding the thread end along a moistening surface, wherein the moistening takes place before the thread end is pieced in the fiber ring located in the spinning rotor.

2. A process according to claim 1, wherein the thinning-out of the thread end is carried out with the aid of an air current and wherein the subsequent moistening process takes place without the air current.

3. A process according to claim 1, wherein the degree of dampness of the moistening surface is dependent on the number of previously performed piecing processes.

4. A process according to claim 2, wherein the degree of dampness of the moistening surface is dependent on the number of previously performed piecing processes.

5. An arrangement for preparing a piecing process in an open-end rotor spinning aggregate, comprising:

a suction tube for thinning out a thread end and having an entry opening for a cross-cut thread end to be pieced, and a device arrangeable at the suction tube for moistening the thread end, wherein the device for moistening comprises a moistening surface, which moistening surface can be selectively movably positioned at the entry opening of the suction tube after the thinning-out process is completed and along which the thinned-out thread end slides when it is being withdrawn from the suction tube.

6. An arrangement according to claim 5, wherein the moistening surface comprises a sponge or the like which can be dampened.

7. An arrangement according to claim 5, wherein the moistening surface can only then be removed from the suction tube when the thread end is completely withdrawn from the suction tube.

8. An arrangement according to claim 6, wherein the moistening surface can only then be removed from the suction tube when the thread end is completely withdrawn from the suction tube.

9. An arrangement according to claim 5, wherein the moistening surface is connected to a container holding water.

10. An arrangement according to claim 9, wherein a magnetic valve is disposed in a water line connecting the container with the moistening surface.

11. An arrangement according to claim 10, wherein a control means is operable to control the magnetic valve, said control means being connected to a piecing process counter.

12. An arrangement according to claim 9, wherein the moistening surface comprises a sponge or the like which can be dampened.

13. An arrangement according to claim 10, wherein the moistening surface comprises a sponge or the like which can be dampened.

14. An arrangement according to claim 11, wherein the moistening surface comprises a sponge or the like which can be dampened.

15. A process for piecing yarn in an open end rotor spinning unit, comprising:

thinning a yarn end to be pieced to form a thinned yarn end, subsequentially moistening the thinned yarn end, and subsequently returning the yarn end to a fiber ring in a rotor of the spinning unit to thereby piece the yarn end with the fiber ring.

16. A process according to claim 15, wherein said thinning includes applying an air current to the yarn end.

17. A process according to claim 16, wherein the moistening is carried out without the air current.

18. A process according to claim 16, wherein the moistening is controlled as a function of the number of previous piecing steps performed.

19. An apparatus for piecing yarn in an open end rotor spinning unit, comprising:

thinning means for thinning a yarn end to be pieced to form a thinned yarn end, moistening means for subsequentially moistening the thinned yarn end, and yarn end returning means for subsequently returning the yarn end to a fiber ring in a rotor of the spinning unit to thereby piece the yarn end with the fiber ring.

20. An apparatus according to claim 19, wherein said thinning means includes means applying an air current to the yarn end.

21. An apparatus according to claim 20, wherein the moistening means includes means for moistening without the air current.

22. An apparatus according to claim 20, wherein the moistening means is controlled as a function of the number of previous piecing steps performed.

23. A process to claim 15, wherein the moistening includes sliding the yarn end over a moistening surface which is selectively movable between a position spaced form the yarn end to a position contacting the yarn end.

* * * * *